US008353251B2

(12) United States Patent
Kawaguchi et al.

(10) Patent No.: US 8,353,251 B2
(45) Date of Patent: Jan. 15, 2013

(54) AUXILIARY TABLE FOR SEWING MACHINE

(75) Inventors: Yasuhiko Kawaguchi, Nagoya (JP); Junnosuke Matsuda, Nagoya (JP); Takahira Osamura, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 178 days.

(21) Appl. No.: 12/872,170

(22) Filed: Aug. 31, 2010

(65) Prior Publication Data

US 2011/0048303 A1 Mar. 3, 2011

(30) Foreign Application Priority Data

Sep. 3, 2009 (JP) ..... 2009-203573

(51) Int. Cl.
*D05B 75/06* (2006.01)

(52) U.S. Cl. ..... 112/217.1

(58) Field of Classification Search ..... 112/217.1, 112/103, 136, 217.2, 470.13, 470.14, 470.18, 112/102.5, 101
See application file for complete search history.

(56) References Cited

U.S. PATENT DOCUMENTS 1,216,945 A * 2/1917 Christie ..... 112/217.1
2,305,343 A * 12/1942 Gadbois Helen M ..... 112/217.1
3,561,383 A * 2/1971 Fresard ..... 112/217.1
4,444,135 A * 4/1984 Yanagi et al. ..... 112/470.04
5,287,640 A * 2/1994 Morgan ..... 38/102.2

FOREIGN PATENT DOCUMENTS

JP U-56-23080 3/1981
JP U-5-51263 7/1993

* cited by examiner

*Primary Examiner* — Tejash Patel
(74) *Attorney, Agent, or Firm* — Oliff & Berridge, PLC

(57) ABSTRACT

An auxiliary table for a sewing machine includes a table body formed into a flat plate shape and including one or more rectangular portions, the table body having corners, an upper surface at an upper side in a direction of gravitational force and an underside at a lower side in the direction of gravitational force, a cloth-receiving member disposed on at least one corner of the table body so as to be located lower than the upper surface of the table body and configured to support the workpiece cloth when it is placed on the upper surface side of the table body and hanging downward from the table body, the cloth-receiving member having a receiving portion having an outer edge surrounding outer edges of the corners, and a supporting member supporting the cloth-receiving member so protrusion of the cloth-receiving member from an outer edge of the table body is changeable.

13 Claims, 9 Drawing Sheets

AUXILIARY TABLE FOR SEWING MACHINE

CROSS-REFERENCE TO RELATED APPLICATIONS

This application is based upon and claims the benefit of priority from the prior Japanese Patent Application No. 2009-203573 filed on Sep. 3, 2009, the entire contents of which are incorporated herein by reference.

BACKGROUND

1. Technical Field

The present disclosure relates to an auxiliary table detachably attached to a sewing machine so that the auxiliary table is coplanar with a sewing bed of the sewing machine.

2. Related Art

For example, when an embroidery pattern is sewn on a large-sized workpiece cloth, such as working wears or stadium jackets, held on an embroidery frame attached to a sewing machine, ends of the workpiece cloth hang down from the embroidery frame. The hanging workpiece cloth tends to be easily caught by corners formed on a sewing machine bed or the like when moved with the embroidery frame for the embroidery pattern to be sewn. As a result, the embroidery frame and the workpiece cloth held on the embroidery frame are prevented from free movement. This would result in a reduction in quality of an embroidery pattern sewn on the workpiece cloth.

In view of the above-described problem, there has conventionally been disclosed a sewing machine table which can provide an easy handling of workpiece cloth thereby to improve the efficiency in an embroidery-sewing work. The disclosed sewing machine table includes a vertical wall surface enlarged into a tapered form so that a workpiece cloth is held on the tapered wall surface as well as on the upper surface of the embroidery frame, whereby the handling of the workpiece cloth can be improved. However, the above-described sewing machine table has a problem that the size thereof and in particular, the vertical dimension thereof are increased.

Furthermore, it is suggested that the size of a generally flat plate-like sewing machine table simply be increased for the purpose of increasing an area of the upper surface on which the workpiece cloth is placed in order that the workpiece cloth may be handled more easily. In this case, however, a larger installation space is necessitated for the sewing machine with the increase in the size of the sewing machine table.

SUMMARY

Therefore, an object of the disclosure is to provide an auxiliary table which can promote a smooth movement of the workpiece cloth and realize high efficient embroidery sewing.

The present disclosure provides an auxiliary table for a sewing machine which includes a sewing machine bed to which the auxiliary table is detachably attached so that a workpiece cloth can be placed thereon, the auxiliary table comprising a table body formed into a flat plate shape in a planar view and including one or a plurality of rectangular portions, the table body having a plurality of corners, an upper surface at an upper side in a direction of gravitational force and an underside at a lower side in the direction of gravitational force; a cloth-receiving member which is provided on at least one of the corners of the table body so as to be located lower than the upper surface of the table body, the cloth-receiving member supporting, from below, the workpiece cloth placed on the upper surface side of the table body and hanging downward from the table body, the cloth-receiving member protruding outward from an outer edge of the table body, the cloth-receiving member having a receiving portion having an outer edge which surrounds outer edges of the corners; and a supporting member which supports the cloth-receiving member so that an amount of protrusion of the cloth-receiving member is changeable.

DETAILED DESCRIPTION

Figure 1:
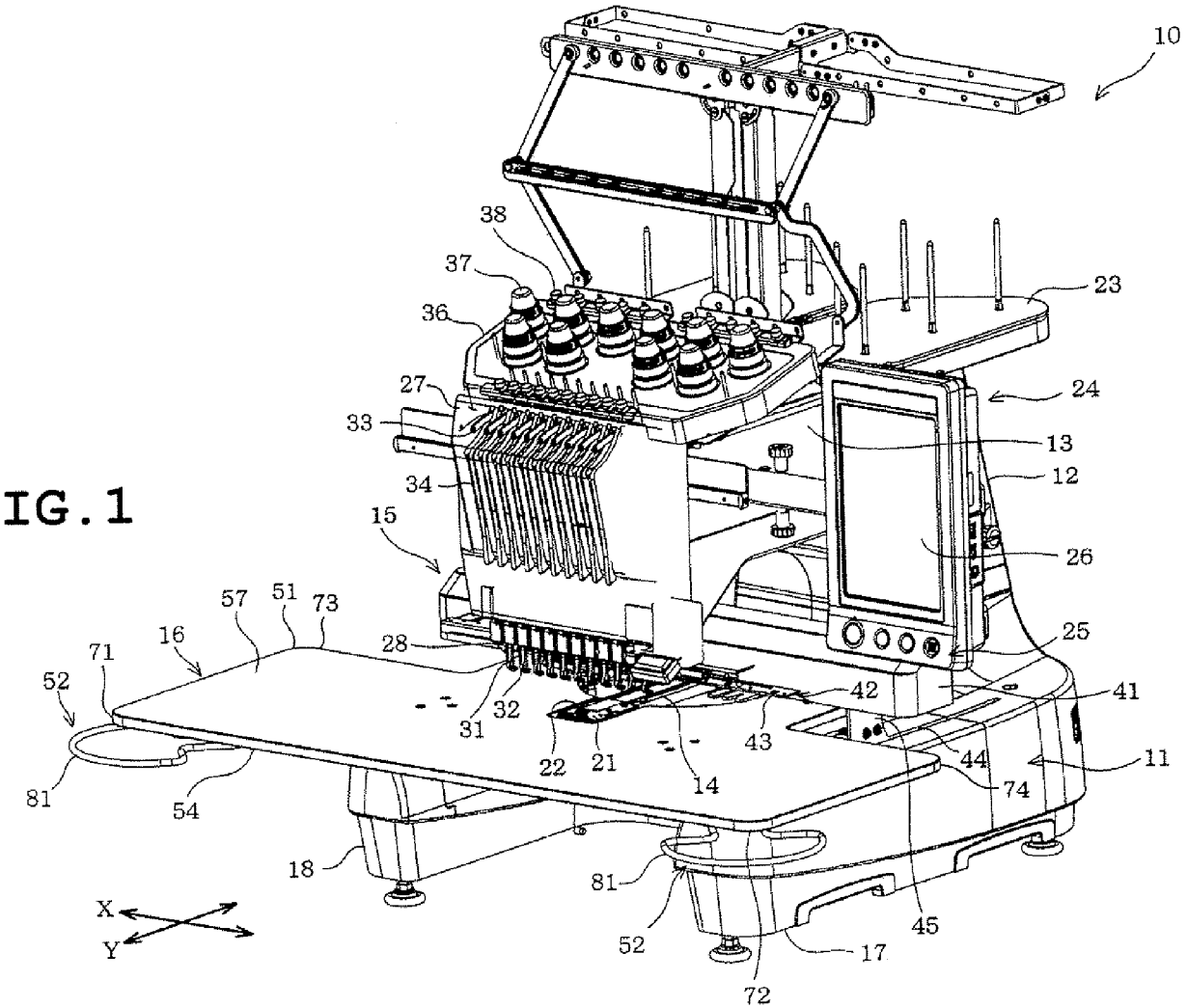
FIG. 1 is a schematic perspective view of a multi-needle embroidery sewing machine to which the auxiliary table in accordance with a first embodiment is applied.

Several embodiments will be described with reference to the accompanying drawings. Identical or similar parts are labeled by the same reference numerals throughout the embodiments.

Figure 2:
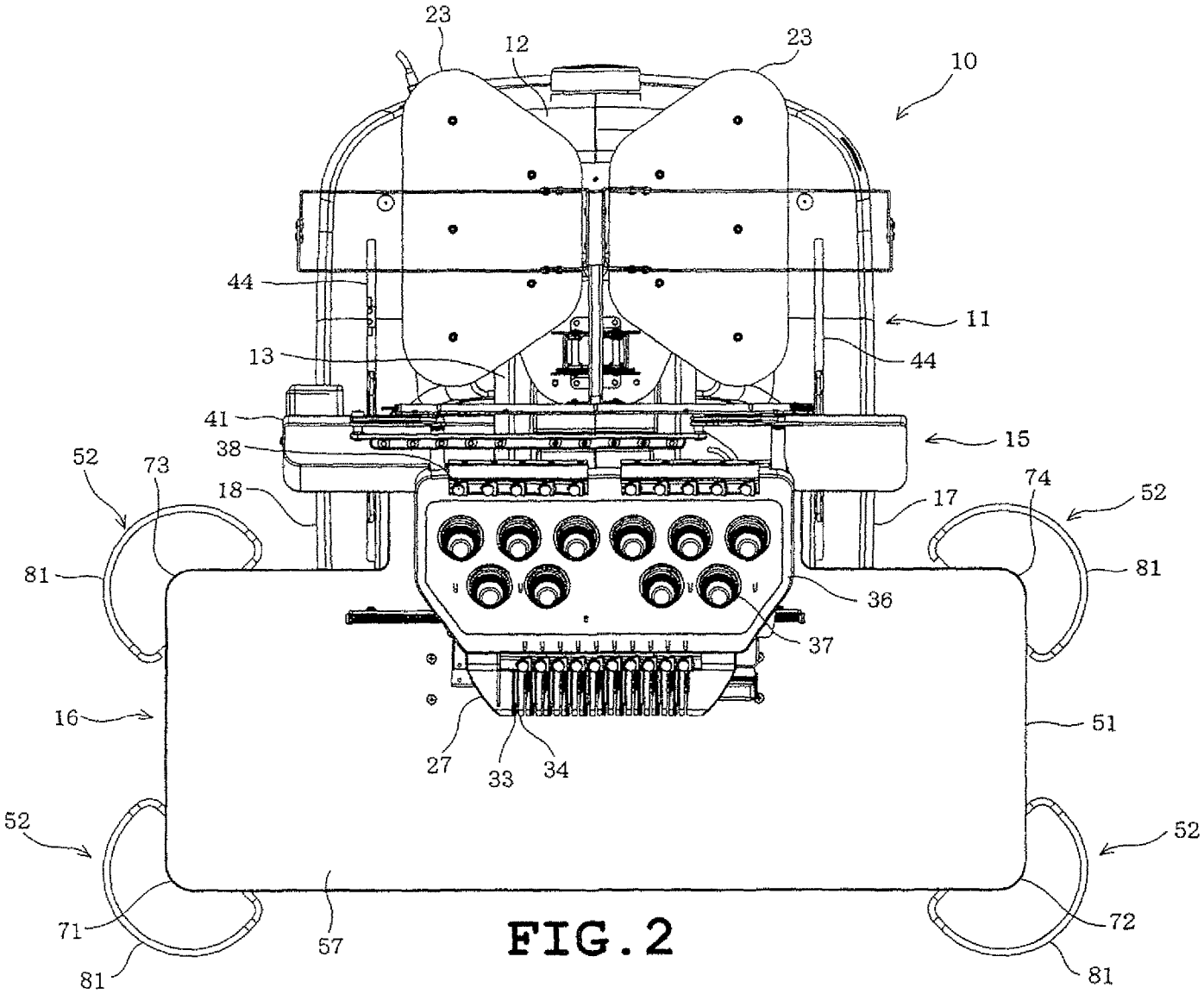
FIG. 2 is a top plan view of the multi-needle embroidery sewing machine.

A first embodiment will now be described with reference to FIGS. 1 to 6 and 8. FIGS. 1 and 2 illustrate a multineedle embroidery sewing machine 10 to which the auxiliary table in accordance with the first embodiment is applied. In the following description, the right-left direction of the sewing machine 10 is referred to as "X direction" and the front-back direction thereof is referred to as "Y direction."

The sewing machine 10 comprises a sewing machine bed 11 (hereinafter, referred to as "sewing bed"), a support pillar 12, an arm 13, a transfer mechanism 15 and an auxiliary table 16. The sewing bed 11 is placed on a loading table (not shown). The support pillar 12 extends upward from a rear end of the sewing bed 11. The arm 13 extends frontward from an upper end of the support pillar 12. The sewing bed 11 has right and left legs 18 and 17 extending frontward. Thus, the sewing bed 11 is formed into a generally inverted U-shape and has an open front. The sewing bed 11 includes a cylinder bed 14 which extends frontward from an inner central part of the inverted U-shape of the sewing bed 11. The cylinder bed 14 is formed integrally with the sewing bed 11 and has a needle plate 21 provided on an upper part of the front end side. The needle plate 21 has a needle hole 22. A thread capturing hook (not shown), a thread cutting mechanism, a picker and the like are accommodated in a front end side interior of the cylinder bed 14 although none of them are shown.

A spool holder 23 is provided above a rear end side of the arm 13. A plurality of thread spools (not shown) is mounted on the spool holder 23. An operation panel 24 is provided on the right side of the arm 13 and includes a plurality of operation switches 25, and a liquid-crystal display 26. Each operation switch 25 accepts various instructions, selection and input operations from the user. The liquid-crystal display 26 displays necessary messages and the like for the user. The operation panel 24 is eliminated in FIG. 2.

The arm 13 has a distal end on which a needle-bar case 27 is mounted. The needle-bar case 27 is movable in the X direction or a right-left direction. A plurality of thread spools (not shown) is mounted to the spool holder 23. The needle-bar case 27 is formed into the shape of a low-profile box having a larger longitudinal thickness than a horizontal thickness. A plurality of needle bars 28 is mounted in the needle-bar case 27 so as to be vertically movable. Ten needle bars 28 are mounted in the first embodiment. The needle bars 28 are biased upward by spring forces of respective coil springs (not shown). The needle bars 28 have lower ends which protrude downward from the lower end of the needle-bar case 27 respectively. Sewing needles 31 for embroidery sewing are changeably mounted to the lower ends of the needle bars 28 protruding out of the needle-bar case 27.

Presser feet 32 for embroidery sewing are provided below the respective needle bars 28 so as to be vertically movable in synchronization with the vertical movement of the needle bars 28. Furthermore, a plurality of needle thread take-up levers 33 are provided above the needle-bar case 27 so as to correspond to the needle bars 28 respectively. The needle thread take-up levers 33 have distal ends protruding forward through vertically extending slits 34 formed in the front side of the needle-bar case 27 respectively, whereby the needle thread take-up levers 33 are vertically swung in synchronization with the vertical movement of the needle bars 28 respectively.

The needle-bar case 27 includes an upper cover 36 which is formed integrally therewith and extends obliquely rearward from an upper end thereof. A plurality of thread tensioners corresponding to the respective needle bars 28 are provided on the upper cover 36. A plurality of thread breakage sensors 38 corresponding to the respective needle bars 28 are also provided on an upper end of the upper cover 36. In the first embodiment where the sewing machine 10 is provided with ten needle bars 28, ten thread tensioners 37 and ten thread breakage sensors 38 are provided. As the result of the above-described construction, needle threads are drawn from respective thread spools set on the spool holder 23 and passed through respective thread break sensors 38, thread tensioners 37, thread take-up levers 33 and the like sequentially. The needle threads are finally passed through the eyes of the needles 9 respectively, whereupon the embroidery sewing is executable. In this case, when different colors of threads are supplied to ten needles 31, an embroidery sewing operation can continuously be carried out using the needle threads of a plurality of colors while the threads are automatically changed.

A sewing machine motor (not shown) is accommodated in the support pillar 12. In the arm 13 are provided a main shaft (not shown) driven by the sewing machine motor, a needle-bar vertical drive mechanism (not shown) which is driven by the sewing machine motor to vertically drive the needle bars 28, a needle-bar selecting mechanism (not shown) moving the needle-bar case 27 in the X direction to select one of the needle bars 28, and the like, as well known in the art. The thread capturing hook (not shown) is driven by the main shaft in synchronization with the vertical movement of the need bar 28.

The needle-bar vertical drive mechanism has a vertically moving member (not shown) which is selectively engages a needle bar bracket (not shown) provided on each needle bar 28. The needle-bar selecting mechanism moves the needle bar case 27 in the X direction with a needle-bar selecting motor serving as a drive source, thereby engaging the needle bar 28 located right above the needle hole 22 with the vertically moving member. As the result of this construction, the selecting single needle bar 28 and the needle thread take-up lever 33 corresponding to the selected needle bar 28 are vertically driven by the needle-bar vertical drive mechanism.

The transfer mechanism 15 is provided above the sewing bed 11 in front of the support pillar 12. In the execution of embroidery sewing, an embroidery frame (not shown) holding a workpiece cloth on which embroidery sewing is to be executed is detachably attached to the transfer mechanism 15. A plurality of embroidery frames are prepared and differ in the size and configuration.

The transfer mechanism 15 has a Y-direction carriage 41, an X-direction carriage 42, and a frame holder 43. The X-direction carriage 42 is provided in the Y-direction carriage 41. The frame holder 43 is provided on the X-direction carriage 42. The transfer mechanism 15 includes a Y-direction drive mechanism and an X-direction drive mechanism. The Y-direction drive mechanism is accommodated inside the sewing bed 11 to drive the Y-direction carriage 17 in the Y direction or in the front-back direction. The X-direction drive mechanism is accommodated inside the Y-direction carriage and drives the X-direction carriage 42 and the frame holder 43 in the X direction or in the right-left direction. As a result, an embroidery frame attached to the frame holder 43 is freely transferred in two directions of X and Y by the transfer mechanism 15.

The Y-direction carriage 41 is formed into the shape of a box extending in the right-left direction and located so as to straddle the legs 17 and 18 of the sewing bed 11. The legs 17 and 18 have guide grooves 44 formed in upper portions respectively. The Y-direction drive mechanism (not shown) has a moving portion 45 which extends vertically through the guide groove 44 and is movable in the front-back direction along the guide groove 44. The moving portion 45 has an upper end connected to both right and left ends of the Y-direction carriage 41.

The Y-direction drive mechanism comprises a linear transfer mechanism including a Y-direction drive motor comprising a stepping motor, a timing pulley and a timing belt although none of which are shown. The moving portion 45 is moved in the front-back direction by the linear transfer mechanism with the Y-direction drive motor serving as a drive source so that the Y-direction carriage 41 is driven freely in the front-back direction.

The X-direction carriage 42 includes a part which protrudes frontward from below the front end side of the Y-direction carriage 41, and is formed into the shape of a plate extending in the right-left direction. The X-direction carriage 42 is supported on the Y-direction carriage so as to be slidable in the X direction. The X direction drive mechanism accommodated in the Y-direction carriage 41 comprises a linear transfer mechanism including an X-direction drive motor, a timing pulley and a timing belt although none of which are shown. The X-direction carriage 42 is freely driven in the right-left direction by the linear transfer mechanism with the X-direction drive motor serving as a drive source.

Figure 3:
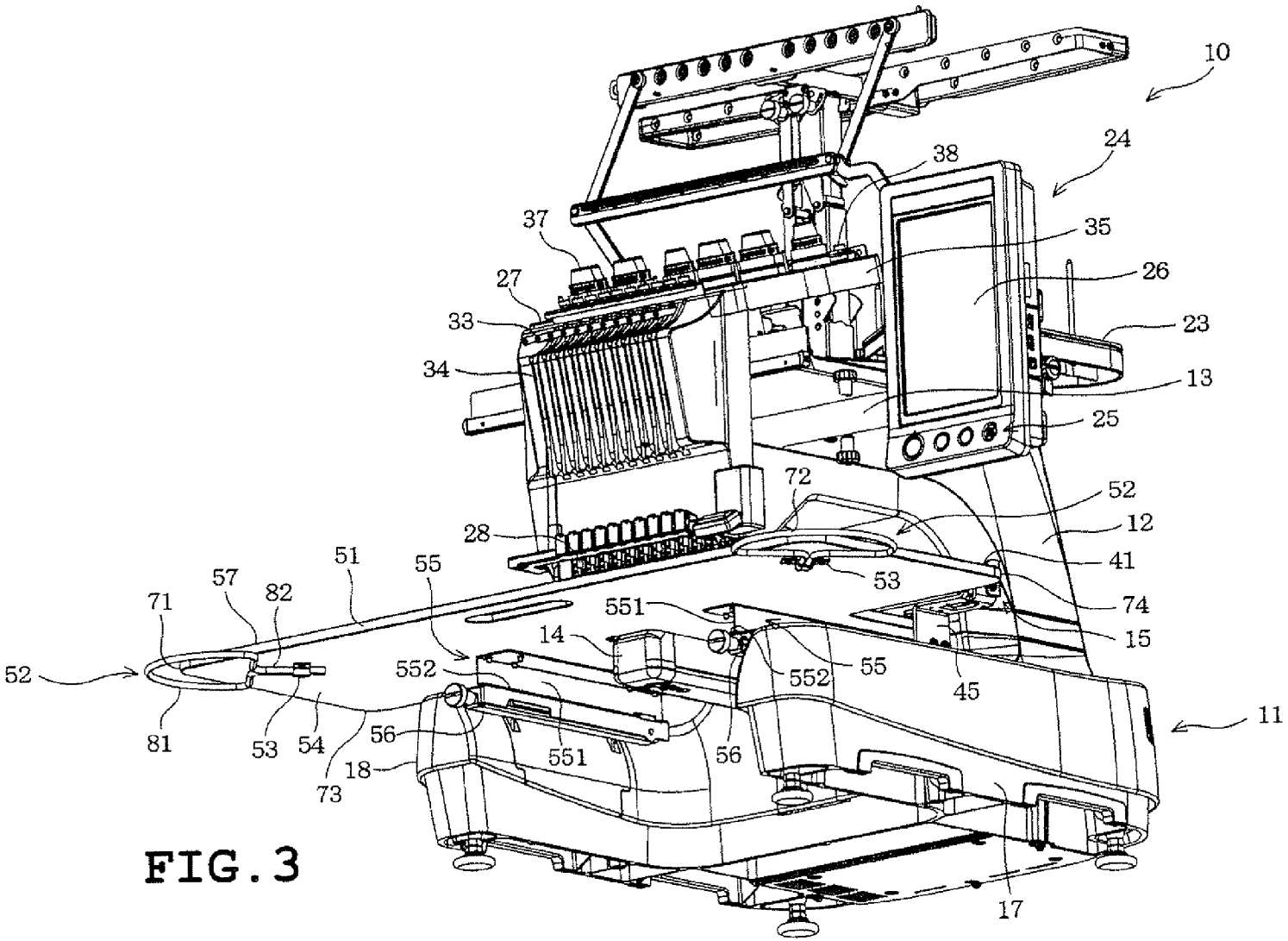
FIG. 3 is a perspective view of the multi-needle embroidery sewing machine as viewed from below.

The auxiliary table 16 will now be described in detail. The auxiliary table 16 comprises a table body 51, a cloth-receiving member 52 and a support member 53 as shown in FIG. 3. The auxiliary table 16 is detachably attached to a part of the sewing machine located above the sewing bed 11 as shown in FIGS. 1 and 3. The auxiliary table 16 has a pair of engagement portions 55 at the side of the underside 54 of the table body 51 as shown in FIG. 3. The engagement portions 55 are adapted to engage a pair of guide members 56 provided on the legs 17 and 18 of the sewing bed 11 respectively. The engagement portions 55 have plate members 551 extending in the front-back direction and pins (not shown) protruding from the plate members 551 to the guide member side. The guide members 56 have grooves (not shown) that are formed inside so as to extend in the front-back direction, respectively. The pins are engaged with the grooves and guided by the grooves so as to be movable in the front-back direction respectively. As a result, the engagement portions 55 and the guide portions 56 are movable in the front-back direction relative to each other, and the auxiliary table 16 is also movable relative to the sewing bed 11.

In attaching the auxiliary table 16 to the sewing machine 10, the pins of the engagement portions 55 of the auxiliary table 16 are engaged with the respective grooves of the guide members 56. The upper end of the auxiliary table 16 is lifted up with the pins in engagement with the respective grooves and then thrust rearward while the auxiliary table 16 is held substantially in parallel to the upper surface of the cylinder head 14. When the pins in engagement with the respective grooves have reached the rear ends of the guide members 56, the rearward movement thereof is limited. The auxiliary table 16 is held above the sewing bed 11 when stepped portions 552 of the guide members 56 are brought into contact with the upper surfaces of the guide members 56 respectively.

On the other hand, when the auxiliary table 16 is to be detached from the sewing machine 10, the front end of the auxiliary table 16 is lightly lifted up so that the stepped portions 552 and the upper surface of the guide member are released from the engaged state. Thereafter, the auxiliary table 16 is drawn back frontward. In this case, the auxiliary table 16 is moved frontward while the pins are engaged with the grooves thereby to be guided by the grooves respectively. After the auxiliary table 16 has been returned to the frontward attachment position, the auxiliary table 16 lifted upward such that the pins and the grooves are disengaged from each other, whereupon the auxiliary table 16 is detached from the sewing machine 10.

Figure 4:
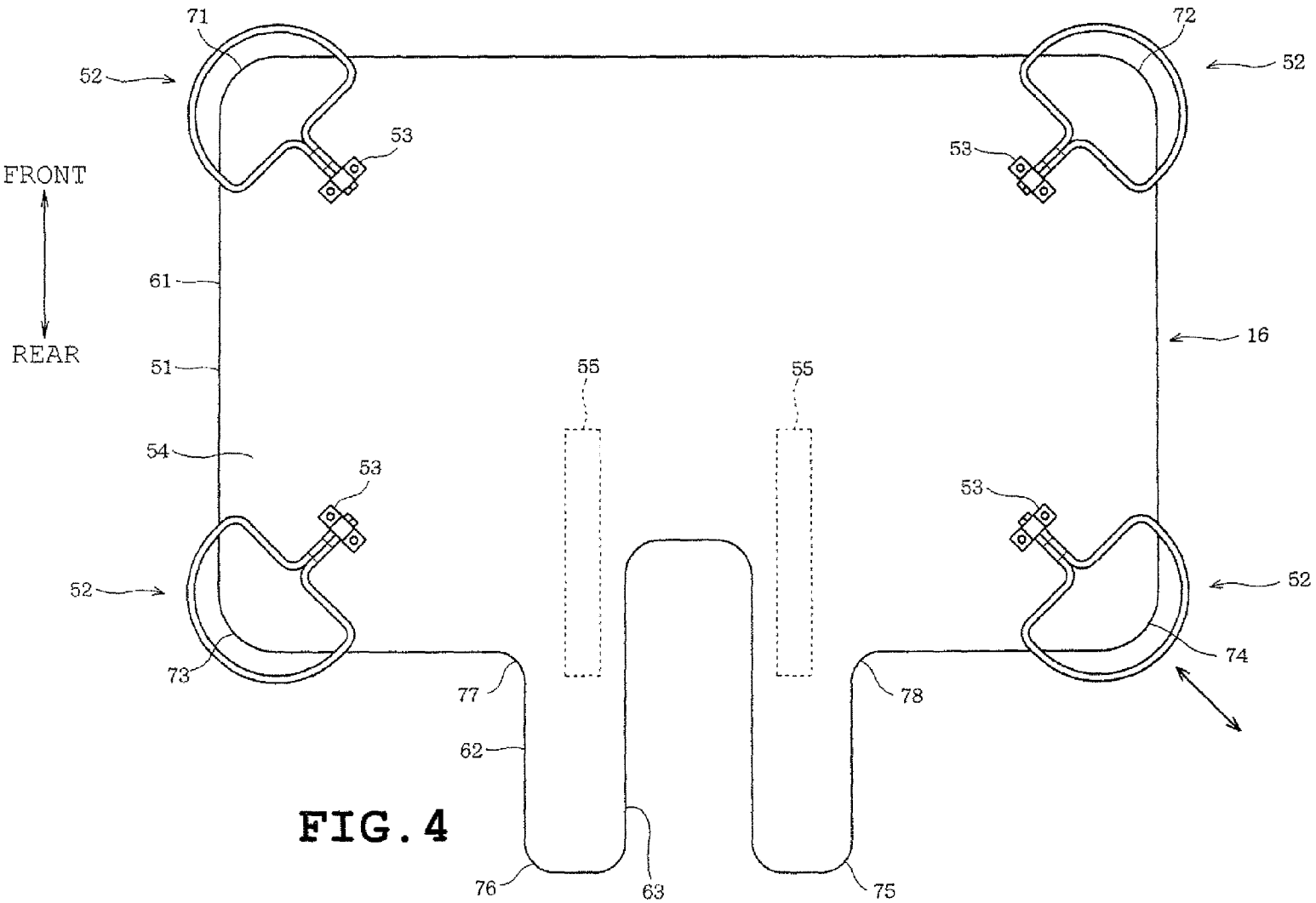
FIG. 4 is a schematic diagram of the auxiliary table as viewed from below.

The table body 51 has the above-described underside 54 and an upper surface 57 located opposite the underside 54. When the sewing machine 10 is mounted on the mounting (not shown), the upper surface 57 is directed upward in the direction of gravitational force and the underside 54 thereof is directed downward in the direction of gravitational force. The table body 51 is formed into the shape of a plate comprising a single rectangular portion or a combination of a plurality of rectangular portions. In the embodiment, as shown in FIG. 4, the table body 51 has a large rectangular baseplate 61 and a rectangular insertion portion 62 protruding rearward from the baseplate 61. The insertion portion 62 has a notch 63 which is formed in a middle part of the rear side of the table body 51 so as to extend from the rear side toward the front side. The cylinder bed 14 is inserted into the notch 63. The table body 51 is thus formed by combining the plural rectangular portions. Accordingly, the auxiliary table 16 has a plurality of corners 71, 72, 73, 74 75, 76, 77 and 78 in outer edges thereof. The corners 71 to 76 are external corners which are directed outward, and the other corners 77 and 78 are inside corners which are directed inward. Each of the corners 71 to 78 has am outer edge which is chamfered into an arc shape.

Figure 5:
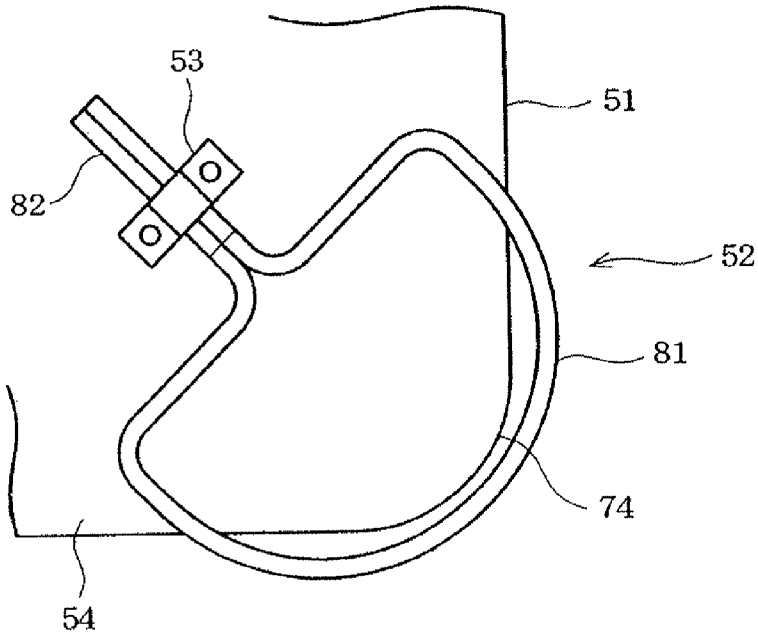
FIG. 5 is a schematic diagram of a cloth-receiving member located at a retreated position.
Figure 6:
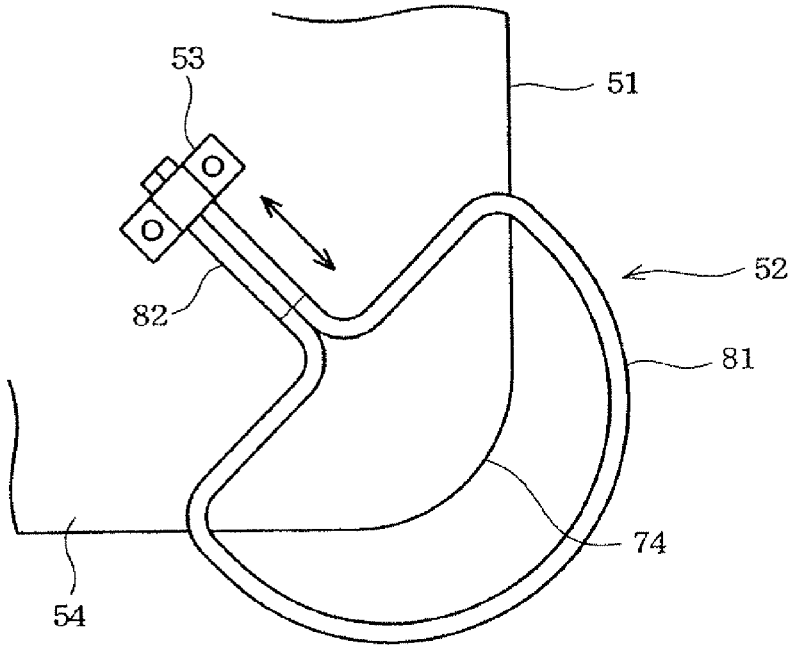
FIG. 6 is a schematic diagram of the cloth-receiving member located at the forward position.

Cloth-receiving members 52 are provided on the corners 71 to 74 respectively. In the embodiment, the cloth-receiving members 52 are disposed on the corners 71 to 74 which are external corners. Each cloth-receiving corner 52 is located lower than the upper surface 57 of the table body 51 in the direction of gravitational force. The cloth-receiving members 52 are supported by supporting members 53 at the side of the underside of the table body 51 respectively. As a result, the cloth-receiving members 52 are located below the underside 54 of the table body 51 in the embodiment. Each cloth-receiving member 52 has a receiving portion 81 and a base 82 as shown in FIG. 5. The receiving portions 81 are formed so that outer edges thereof surround outer edges of the corners 71 to 74 respectively, as viewed in a planar view. FIGS. 5 and 6 exemplify the corner 74 for the sake of easiness in the explanation. The receiving portions 81 are formed into the shape of an arc larger than radii of the chamfered corners 71 to 74 respectively. Each cloth-receiving member 52 includes the receiving portion 81 and the base 82 both of which are integrally formed of a wire rod, in the embodiment. The wire rod has a substantially circular section.

The support members 53 are provided on the underside 54 of the table body 51 to support the above-described cloth-receiving members 52 respectively so that amounts of protrusion of the receiving portions 81 from the outer edges of the table body 51 are changeable respectively. More specifically, the bases 82 of the cloth-receiving members 52 are supported by the support members 53 and movable radially with respect to the corners 71 to 74, respectively. Consequently, the receiving portions 81 integrally formed with the bases 82 are movable radially with respect to the corners 71 to 74, whereupon amounts of protrusion of the receiving portions 81 are changeable into arbitrary values, respectively, as shown in FIGS. 5 and 6.

The auxiliary table 16 described above will work as follows. The auxiliary table 16 is provided with the cloth-receiving members 52 located particularly at the corners 71 to 74 forming the external corners on the underside of the table body 51 respectively, as shown in FIGS. 1 to 4. The cloth-receiving members 52 have the receiving portions 81 protruding outside the corners 71 to 74 of the table body 51 or more specifically, protruding radially outside the corners 71 to 74, respectively.

Figure 7:
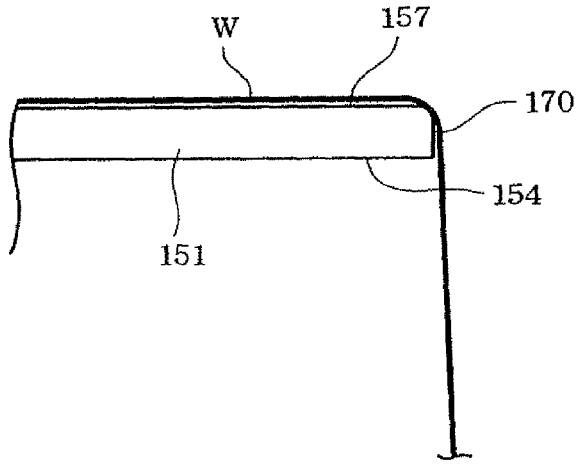
FIG. 7 RELATED ART
FIG. 7 is a schematic diagram of a workpiece cloth placed on a conventional auxiliary table with no cloth-receiving member as viewed sideways.

In the conventional construction, the workpiece cloth W is placed on the upper surface 157 side of the table body 151 as shown in FIG. 7. When the workpiece cloth W is larger than the area of the table body 151, part of the workpiece cloth W running over the table body 151 hangs downward. In this case, the overrunning part of the workpiece cloth W hangs substantially vertically downward from a corner 170 of the table body 151. Accordingly, the friction caused between the table body 151 and the workpiece cloth W is increased in part of the workpiece cloth W in contact with the corner 170 of the table body 151. As a result, the workpiece cloth W placed on the table body 151 tends to be easily caught on the corner 170 of the table body 151.

Figure 8:
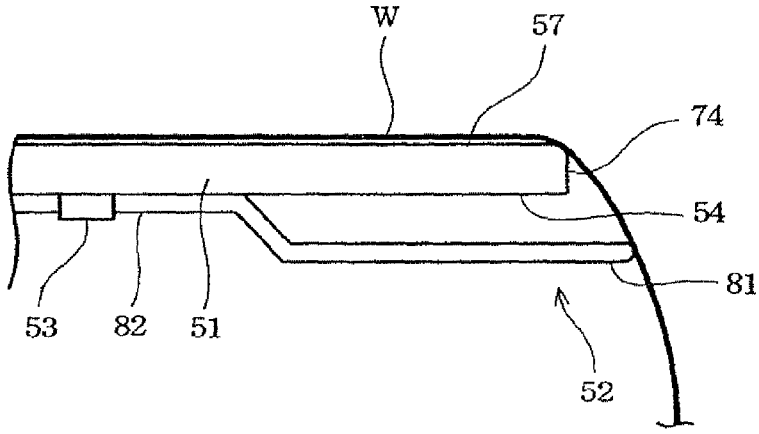
FIG. 8 is a schematic diagram of the workpiece cloth placed on the auxiliary table as viewed sideways.

On the other hand, the workpiece cloth W placed on the upper surface of the table body 51 is pushed thereby to be spread outward when the receiving portion 81 protruding out of the outer edge of the corner 74 is provided below the table 51 in the embodiment as shown in FIG. 8. As a result, the workpiece cloth W is bent thereby to be divided into a part running over the table body 51 and another part placed on the upper surface 57 of the table body 51. Since a bending angle in this case is an obtuse angle that is larger than 90 degrees, the friction caused between the table body 151 and the workpiece cloth W is reduced in part of the workpiece cloth W in contact with the corner 170 of the table body 151 as compared with the conventional construction in FIG. 7. Consequently, the workpiece cloth W placed on the table body 51 can be moved smoothly along the upper surface 56 side of the table body 51 without being caught on the corner 74 of the table body 51. Although only one corner 74 is shown in FIG. 8 for the sake of easiness in the description, the foregoing description can also be applied to the other corners 71 to 73.

The following effect can be achieved from the above-described auxiliary table 16. The workpiece cloth W running over the table body 51 thereby to hang downward is supported by the cloth-receiving member 52 below the corners 71 to 74 of the table body 51. Accordingly, the cloth-receiving member 52 supports the workpiece cloth W outside the outer edge of the table body 51. As a result, the workpiece cloth W is bent thereby to be divided into the part placed on the upper surface 57 of the table body 51 and the part hanging downward from the table body 51. The bending angle in this case is an obtuse angle. Furthermore, an amount of outward protrusion of the workpiece cloth W from each of the outer edges of the corners 71-74 of the table body 51 can be changed by the support member 53 of the cloth-receiving member 52. This results in an optionally adjustable angle made by the part of the workpiece cloth W placed on the upper surface 57 of the table body 51 and the part hanging downward from the table body 51. Consequently, when the workpiece cloth W is moved along the upper surface 57 of the table body 51, the workpiece cloth W hanging downward from the table body 51 is smoothly moved without being caught on the corners 71-74 of the table body 51. Thus, a smooth movement of the workpiece cloth W can be achieved without increasing the size of the table body 51 even when the workpiece cloth W is large in size. Furthermore, when embroidery sewing is to be executed by the use of the sewing machine 10, an embroidery pattern with high accuracy can be sewn by ensuring smooth movement of the workpiece cloth W.

The receiving portions 81 of the cloth-receiving members 52 are formed so as to surround the outer edges of the corners 71-74 in a planar view respectively. Accordingly, the hanging part of the workpiece cloth W is pushed thereby to be spread large such that a larger angle is made between the part of the workpiece cloth W placed on the upper surface 57 of the table body 58 and the hanging part. Consequently, in moving the workpiece cloth W along the upper surface 57 of the table body 51, the part of the workpiece cloth W hanging downward from the table body 51 is moved smoothly without being caught by the corners 71 to 74 of the table body 51. Accordingly, even when large in size, the workpiece cloth W can smoothly be moved.

The cloth-receiving portions 81 are formed into the shape of an arc equal to or larger than radii of the corners 71 to 74 on which the workpiece cloth W easily tends to be caught, respectively. Accordingly, since the part of the workpiece cloth W located below the table body 51 is spread outward, a smooth movement of the workpiece cloth W can be ensured.

The bases 82 of the cloth-receiving members 52 are supported by the support members 52 so as to be movable radially with respect to the corners 71-74, respectively. Accordingly, amounts of outward movement from the outer edges of the table body 51 can be changed to optional values by the cloth-receiving members 52 respectively. As a result, an amount of protrusion of each cloth-receiving member 52 protruding from the outer edge of the table body 51 is changed by the change of the size of the workpiece cloth, the material, the weight of the workpiece cloth W or the like. Thus, since the workpiece cloth W can be supported at an optimum position according thereto, a smooth movement of the workpiece cloth W can be ensured.

Each cloth-receiving member 52 is formed of the wire rod having a substantially circular section. Thus, each cloth-receiving member 52 has a surface having a curved shape. As a result, the workpiece cloth W tends to be easily slid on the surface of each cloth-receiving member 52. Furthermore, each cloth-receiving member 52 can be rendered lightweight when formed of the wire rod.

Figure 9:
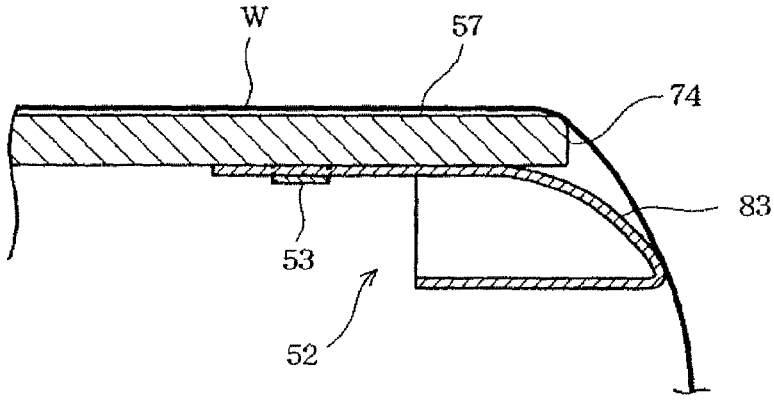
FIG. 9 is a schematic diagram of the workpiece cloth placed on the auxiliary table in accordance with a second embodiment as viewed sideways.

FIG. 9 illustrates one of the cloth-receiving members of the auxiliary table in accordance with a second embodiment. In the second embodiment, each cloth-receiving member 52 includes a receiving portion 83 that is formed into a partially spherical shape as shown in FIG. 9. More specifically, each cloth-receiving member 52 is formed of the wire rod into a planar arc shape in the first embodiment. On the other hand, in the second embodiment, each cloth-receiving member 52 includes a receiving portion 83 that is formed into a stereoscopic inverted bowl shape. One of the corners 71-74, that is, the corner 74 will be described in the second embodiment, too. Furthermore, in the second embodiment, the workpiece cloth W includes the portion placed on the upper surface 57 and the portion hanging downward from the corner 74. The bending angle made by these portions is an obtuse angle in the same manner as in the first embodiment. Furthermore, when each receiving portion 83 is formed into the partially spherical shape, the portion of the workpiece cloth W hanging downward from the table body 51 is smoothly moved while guided by the spherical receiving portion 83. Accordingly, the workpiece cloth W can smoothly be moved without rendering the table body 51 large-sized even when the workpiece cloth W is large in size.

Figure 10:
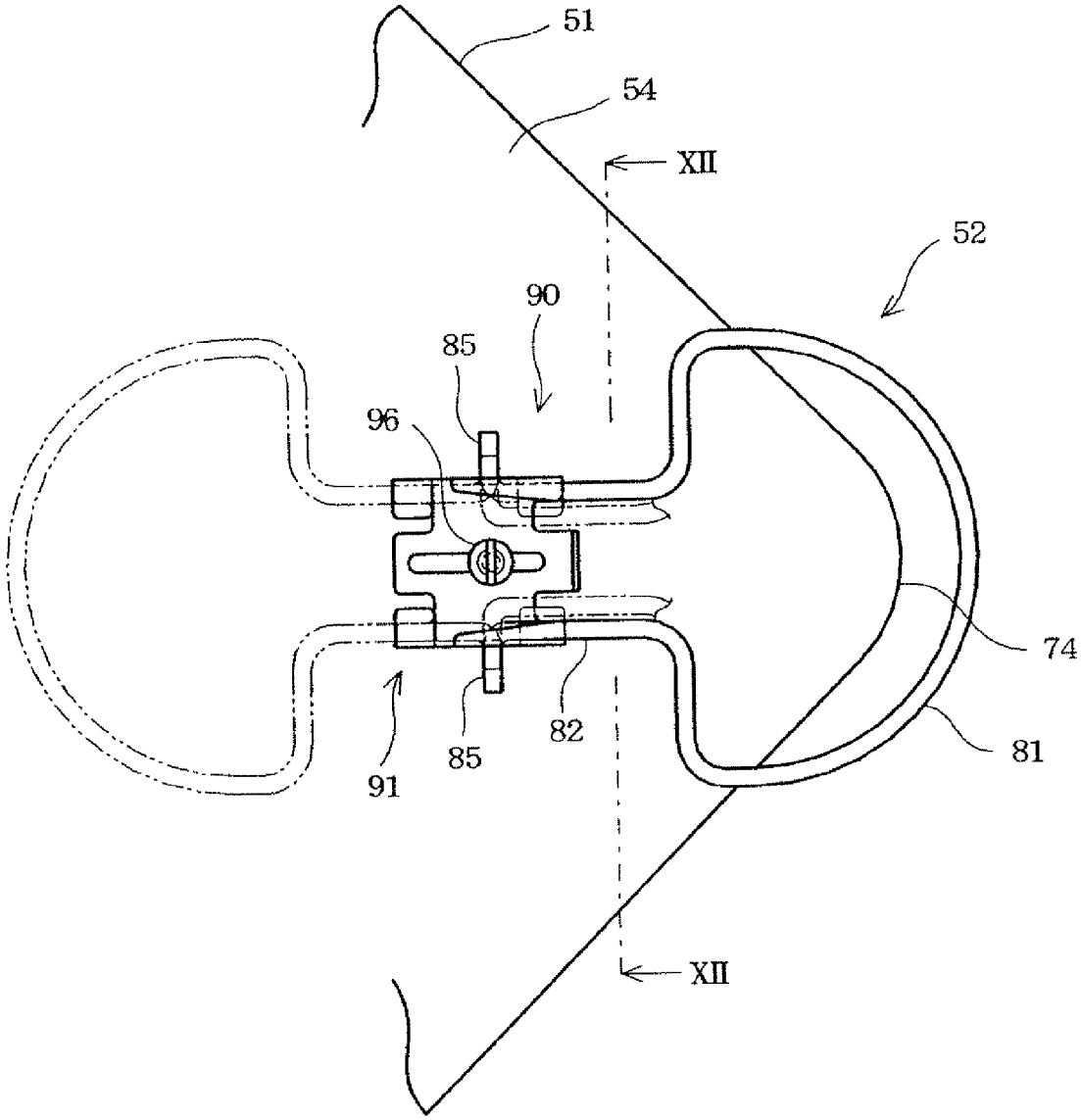
FIG. 10 is a partially enlarged schematic view of the auxiliary table in accordance with a third embodiment, showing the cloth-receiving member as viewed from below.
Figure 11:
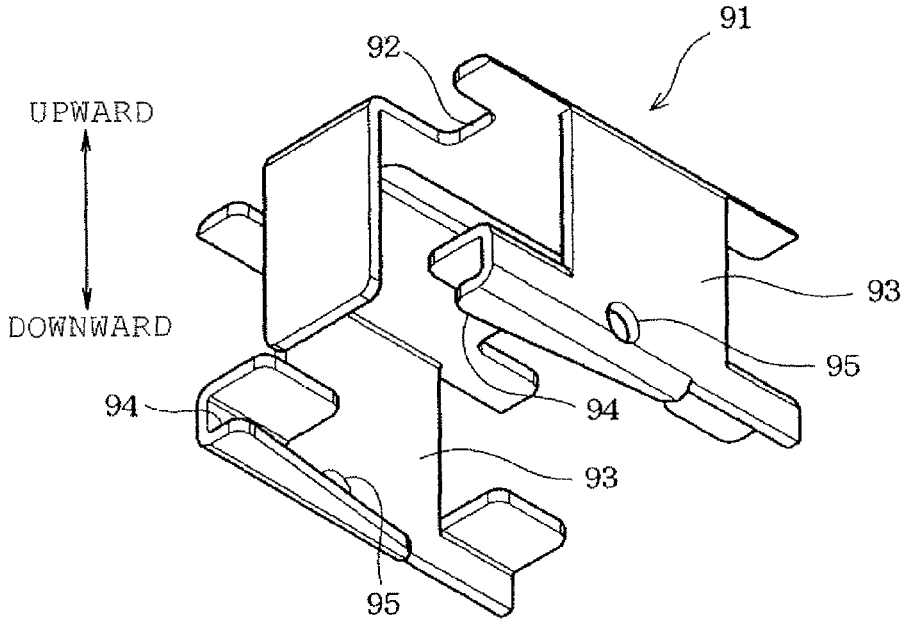
FIG. 11 is a schematic perspective view of the supporting member of the auxiliary table.

FIG. 10 illustrates a third embodiment. In the third embodiment, the auxiliary table 16 is provided with a switching mechanism 90 as shown in FIG. 10. One of the corners 71-74, that is, the corner 74 will be described in the third embodiment, too. The switching mechanism 90 switches the cloth-receiving member 52 between a support position as shown by solid line in FIG. 10 and a retreat position as shown by broken line in FIG. 10. When the cloth-receiving member 52 is located at the support position, the cloth-receiving member 52 protrudes outward from the outer edge of the corner 74 of the cloth-receiving member 52 as shown by solid line in FIG. 10. When the cloth-receiving member 52 is located at the retreat position, the cloth-receiving member 52 is retreated inside the outer edge of the corner 74 as shown by broken line in FIG. 10. The switching mechanism 90 comprises a support member 91 supporting the base 82 of the cloth-receiving member 52. The support member 91 has a pedestal 92, two walls 93 opposed to each other and two flanges 94. The pedestal 92 is adjacent to the table body 51 when attached to the table body 51. The walls 93 extend from both ends of the pedestal 92 toward the side opposed to the table body 51, that is, downward. The flanges 94 are provided on the walls 93 which have ends opposed to the pedestal 92 respectively and from which the flanges 94 protrude inward or to the opposed other wall 93 side.

Each base 82 has an end which is located at the side opposed to the cloth-receiving portion 81, as shown in FIG.

10. The end of each base 82 has a protrusion 85 protruding outward substantially perpendicular to the base 82. The protrusion 85 is formed integrally with the cloth-receiving portion 81 and the base 82 from a single wire rod. The support member 91 has shaft supports 95 which are formed through the walls 93 and support the protrusions 85 so that the protrusions 85 are rotatable, respectively.

Figure 12:
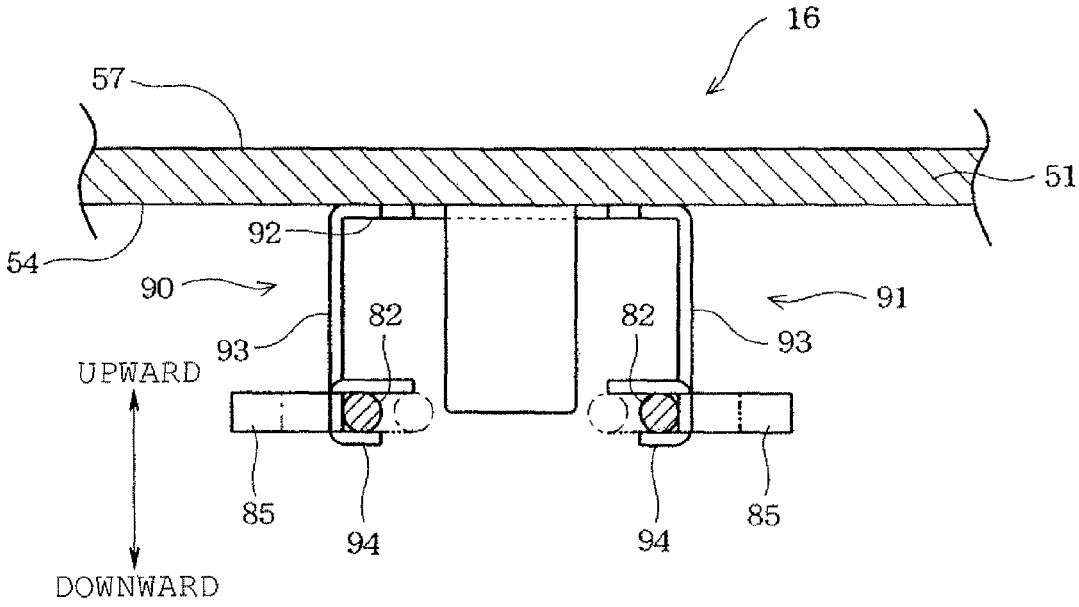
FIG. 12 is a sectional view taken along line XII-XII in FIG. 10.

When each cloth-receiving member 52 is located at the support position, a lower end of the base 82 thereof is in contact with the flange 94, as shown in FIG. 12. This limits the rotational transfer of each cloth-receiving member 52 to the side opposed to the table base 51 about the protrusion 85 supported on the shaft support 95 or downward. Furthermore, when no force is applied to the base 82 of each cloth-receiving member 52, the base 82 is pressed against the wall 93 side by the elastic force thereof. Accordingly, the base 82 and the flange 94 are not released from the contact therebetween.

On the other hand, the base 82 of each cloth-receiving member 52 is inwardly flexed by application of a force to the inside of the base 82 formed of the wire rod as shown by broken line in FIG. 12. The base 82 and the flange 94 are released from the contact therebetween by flexing the base 82 so that the base 82 is located on the inside of the flange 94. As a result, the base 82 is passed through the inside of the opposed flange 94 thereby to be rotatable about the shaft support 95. Thus, when a force is applied to each base 82 so that the base 82 and the flange 94 are released from the contact, each cloth-receiving member is rotatable about the shaft support 95, whereupon the cloth-receiving member 52 can be switched between the support position and the retreat position.

Figure 13:
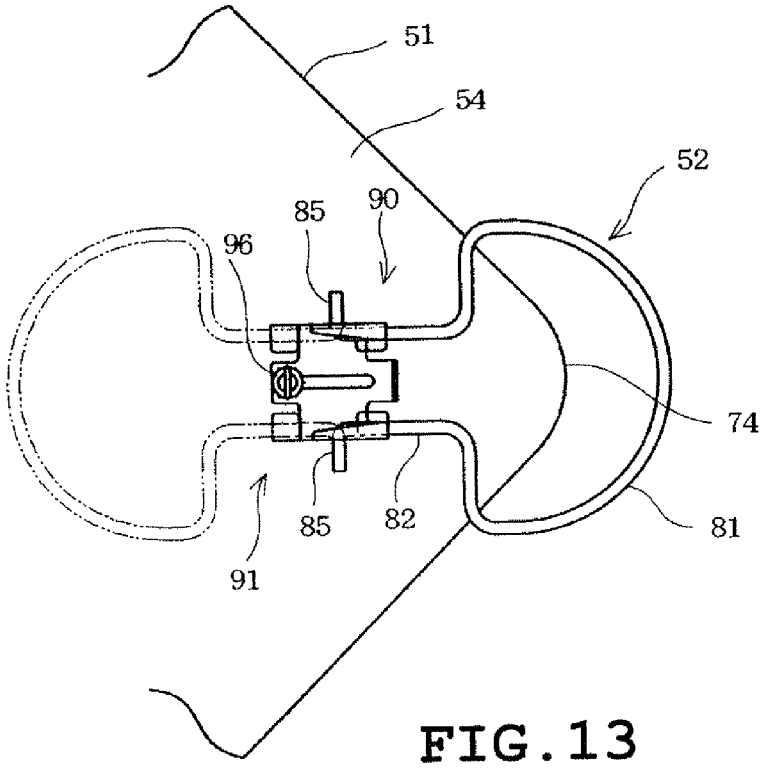
FIG. 13 is a schematic diagram of the cloth-receiving member located at the forward position.
Figure 14:
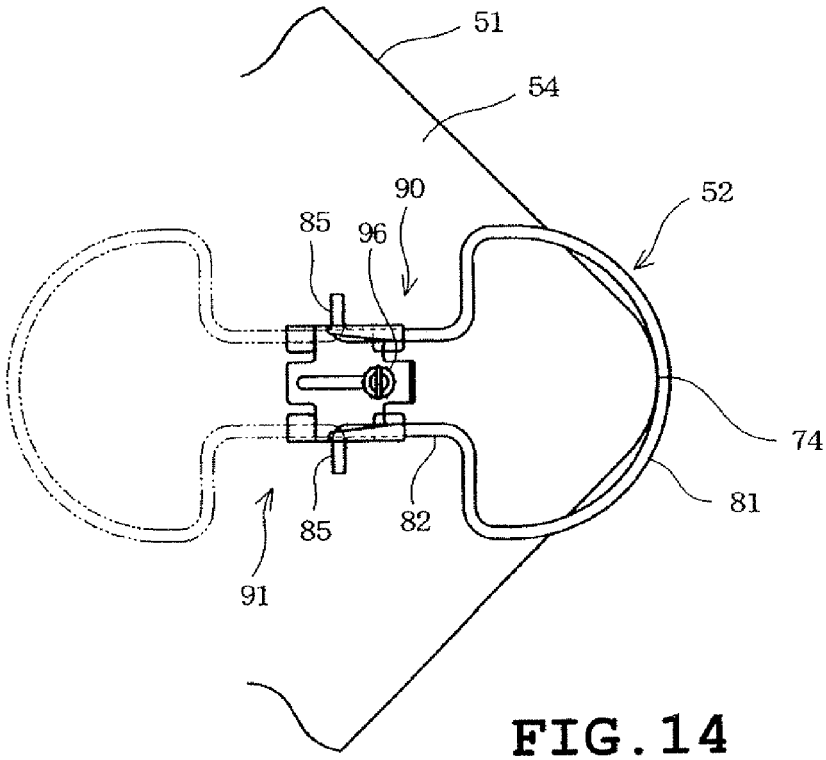
FIG. 14 is a schematic diagram of the cloth-receiving member located at the retreat position.

The pedestal 92 of the support member 91 is mounted on the table body 51 by a fixing member 96 such as a fixing screw as shown in FIG. 10. When the fixing member 96 is loosened, the support member 91 is movable in a radial direction of the corner 74. The support member 91 is fixed to the table body 51 when the fixing member 96 is tightened up. When the fixing member 96 is loosened, the support member 91 is movable between a maximum protrusion support position and a minimum protrusion support position. When located at the maximum protrusion support position, the support member 91 comes close to the corner 74, and the receiving portion 81 is moved away from the corner 74, as shown in FIG. 13. When located at the minimum protrusion support position, the support member 91 is moved away from the distal end of the corner 74, and the receiving portion 81 comes close to the corner 74, as shown in FIG. 14. The fixing member 96 is tightened up at any position so that positions of the support member 91 and the table body 51 or an amount of protrusion of the bearing member 81 is determined. Thus, since the support member 91 is movable in the axial direction of the corner 74, the receiving portion 81 can optionally change the amount of protrusion of the corner 74 from the outer edge as shown in FIGS. 13 and 14.

In the third embodiment, the cloth-receiving member 52 is switched between the support position and the retreat position. Accordingly, in the case where the cloth-receiving member is not necessary or where a small-sized workpiece cloth W is sewn, the cloth-receiving member 52 is switched to the retreat position located on the inside of the outer edge of the table body 51. On the other hand, when a large-sized workpiece cloth W is sewn, the cloth-receiving member 52 is switched to the support position located on the outside of the outer edge of the table body 25. The cloth-receiving member 52 is thus switched to the use or non-use position according to the size and shape of the workpiece cloth W serving as an object to be sewn. Accordingly, the handling of the sewing machine can be rendered easier.

The foregoing embodiments should not be restrictive but may be modified as follows. The cloth-receiving member 52 is provided on the underside of the table body 51 in the foregoing embodiments. However, when having a relatively larger thickness, the cloth-receiving member 52 may be provided between the upper surface 57 and the underside 54 of the table body 51. In this case, an inwardly recessed accommodation hole may be formed in a sidewall of the corner 74 of the table body 51. The cloth-receiving member 52 may be provided so as to be movable into and out of the accommodation hole. Thus, the cloth-receiving member 52 is located lower than the upper surface of the table body 51. Accordingly, a part of the workpiece cloth W placed on the upper surface 57 and a part of the workpiece cloth hanging downward from the table body 51 are bent, and a bending angle therebetween can be rendered obtuse. Consequently, the catch of the workpiece cloth W on the corners 74 can be reduced such that the workpiece cloth W can smoothly be moved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An auxiliary table for a sewing machine which includes a sewing machine bed to which the auxiliary table is detachably attached so that a workpiece cloth can be placed thereon, the auxiliary table comprising:

a table body formed into a flat plate shape in a planar view and including one or a plurality of rectangular portions, the table body having a plurality of corners, an upper surface at an upper side in a direction of gravitational force and an underside at a lower side in the direction of gravitational force;

a cloth-receiving member which is provided on at least one of the corners of the table body so as to be located lower than the upper surface of the table body, the cloth-receiving member being configured to support, from below, the workpiece cloth when it is placed on the upper surface side of the table body and hanging downward from the table body, the cloth-receiving member protruding outward from an outer edge of the table body, the cloth-receiving member having a receiving portion having an outer edge which surrounds outer edges of the corners; and a supporting member which supports the cloth-receiving member so that an amount of protrusion of the cloth-receiving member is changeable.

2. The auxiliary table according to claim 1, wherein the receiving portion is formed into an arc shape and is equal to or larger than a radius of each corner.

3. The auxiliary table according to claim 1, wherein the cloth-receiving member has an end which is located opposite the receiving portion and has a base, and the supporting member is provided on the underside of the table body and supports the base so that the cloth-receiving member is movable outward from an outer edge of the table body.

4. The auxiliary table according to claim 2, wherein the cloth-receiving member has an end which is located opposite the receiving portion and has a base, and the supporting member is provided on the underside of the table body and supports the base so that the cloth-receiving member is movable outward from an outer edge of the table body.

5. The auxiliary table according to claim 1, wherein the cloth-receiving member is made of a wire rod.

6. The auxiliary table according to claim 1, further comprising a switching mechanism which switches the cloth-receiving member between a supporting position where the cloth-receiving member protrudes outward from an outer edge of the table body and a retreat position where the cloth-receiving member is retreated inside the outer edge of the table body.

7. An auxiliary table for a sewing machine which includes a sewing machine bed to which the auxiliary table is detachably attached so that a workpiece cloth can be placed thereon, the auxiliary table comprising:

a table body formed into a flat plate shape in a planar view and including one or a plurality of rectangular portions, for the table body having a plurality of corners, an upper surface at an upper side in a direction of gravitational force and an underside at a lower side in the direction of gravitational force;

a cloth-receiving member which is provided on at least one of the corners of the table body so as to be located lower than the upper surface of the table body, the cloth-receiving member being configured to support, from below, the workpiece cloth when it is placed on the upper surface side of the table body and hanging downward from the table body, the cloth-receiving member protruding beyond an outer edge of the table body in a direction substantially parallel to the table body; and a supporting member which supports the cloth-receiving member so that an amount of protrusion from the cloth-receiving member is changeable.

8. The auxiliary table according to claim 7, wherein the cloth-receiving member having a receiving portion having an outer edge which surrounds outer edges of the corners.

9. The auxiliary table according to claim 7, wherein the cloth-receiving member is made of a wire rod.

10. The auxiliary table according to claim 7, further comprising a switching mechanism which switches the cloth-receiving member between a supporting position where the cloth-receiving member protrudes outward from an outer edge of the table body and a retreat position where the cloth-receiving member is retreated inside the outer edge of the table body.

11. The auxiliary table according to claim 8, wherein the receiving portion is formed into an arc shape and is equal to or larger than a radius of each corner.

12. The auxiliary table according to claim 8, wherein the cloth-receiving member has an end which is located opposite the receiving portion and has a base, and the supporting member is provided on the underside of the table body and supports the base so that the cloth-receiving member is movable outward from an outer edge of the table body.

13. The auxiliary table according to claim 11, wherein the cloth-receiving member has an end which is located opposite the receiving portion and has a base, and the supporting member is provided on the underside of the table body and supports the base so that the cloth-receiving member is movable outward from an outer edge of the table body.

* * * * *